US006497560B2

(12) United States Patent
Carlson

(10) Patent No.: US 6,497,560 B2
(45) Date of Patent: Dec. 24, 2002

(54) HIGH VOLUME LOW PRESSURE AIR PUMP

(76) Inventor: Robert T. Carlson, 143 Tewksbury Ave., Point Richmond, CA (US) 94801

( * ) Notice: Subject to any disclaimer, the term of this patent is extended or adjusted under 35 U.S.C. 154(b) by 0 days.

(21) Appl. No.: 09/777,374

(22) Filed: Feb. 5, 2001

(65) Prior Publication Data

US 2002/0106293 A1 Aug. 8, 2002

(51) Int. Cl.[7] ..... F04B 39/10

(52) U.S. Cl. ..... 417/553; 417/527; 417/526; 417/440; 417/547; 417/437; 417/555.1; 417/536; 92/58.1; 92/23; 248/346.3

(58) Field of Search ..... 417/527, 526, 417/440, 547, 437, 536, 553, 555.1; 92/58.1, 23; 248/346.3

(56) References Cited

U.S. PATENT DOCUMENTS 56,671 A * 7/1866 Douglas
775,117 A * 11/1904 Park ..... 235/61 PC
1,393,138 A * 10/1921 Kelley ..... 222/386
1,491,388 A * 4/1924 Foster ..... 16/66

* cited by examiner

*Primary Examiner*—Charles G. Freay
*Assistant Examiner*—Emmanuel Sayoc
(74) *Attorney, Agent, or Firm*—Bruce & McCoy; Ernest H. McCoy

(57) ABSTRACT

A high-volume low pressure hand operated air pump comprised of a tube body with a plunger shaft inserted into one end thereof and a check valve at the other end thereof with a floating seal secured to the internal end of the plunger shaft comprised of a captured double sided annular disk having a closed cell foam plastic seal on one side thereof and a plastic stiffener of the same plastic material integrated thereto for supporting the foam sealing side thereof

3 Claims, 4 Drawing Sheets

HIGH VOLUME LOW PRESSURE AIR PUMP

BACKGROUND OF THE INVENTION

1. Field of the Invention

The present invention relates to a mechanical apparatus for pumping air into closed containers. More particularly it relates to a hand powered portable lightweight industrial type air pump for high-volume low pressure air transfer to air inflatable structures. Specifically, it relates to a high-volume low pressure hand operated air pump for large size multiple person white water/river rafts.

2. Description of the Prior Art

The use of a hand pump in one configuration or another for the purpose of pumping air into an inflatable object is well established in the prior art. However, despite the numerous designs, structures, and forms disclosed by the prior art, which have been developed for the accomplishment of the various related objectives, purposes and requirements, the use of hand actuated air pumps heretofore devised and utilized consist basically of familiar, expected, and obvious, configurations, combinations, and arrangements which are too numerous to consider. The two most universally utilized examples of these types of pumps are the ubiquitous T-handled bicycle pump and the step-on squeeze pumps.

The high-volume low pressure air pump contemplated according to the present invention departs substantially from the conventional concepts and designs taught by the prior art, and in doing so, provides an apparatus primarily developed for the purpose of inflating relatively large collapsible structures such as white water/river rafts as described above, but it accomplishes the result with a new, improved, and specifically unique apparatus.

SUMMARY OF THE INVENTION

There are numerous and obvious inefficiencies and disadvantages inherent in the known types of hand or foot operated air pumps presently existing in the prior art such as the fact that the bicycle pumps are heavy and corrode, while plastic foot powered pumps easily break or disintegrate, and both are low volume air pumps. The present invention provides a new lightweight, compact, durable, inexpensive construction wherein the same can be utilized to inflate relatively large collapsible structures while requiring only minimum storage space where such space is at a premium such as when packed on-board a white water/river raft.

The general purpose of the present invention, which will be described hereafter in greater detail, is to provide a new high-volume low pressure hand-operated air pump apparatus and mechanism which has many of the advantages of the old-style reliable air pumps mentioned above and specific novel features that result in a new lightweight high-volume low pressure air pump which is not anticipated, rendered obvious, suggested, or even implied by any of the prior art of hand operated air pumps, either alone or in any combination thereof.

The present invention is a high volume, low pressure air pump comprising an elongated tube body having a guide hole located proximate to a first end thereof and disposed on the cylindrical axis of the tube for surrounding the shaft of a plunger and allowing the intake of air into the tube through the guide hole. The body forms an air chamber between the internal end of the plunger shaft and a second end of the tube.

A plunger shaft is disposed partially internally of the tube body and extends through the guide hole of the body and is formed to reciprocate therein. The shaft includes a handle secured at a first externally exposed end thereof. The length of the shaft is longer than the length of the body.

An air intake floating seal is secured to the internally disposed second opposite end of the shaft. The air intake seal includes a piston secured to the second end of the plunger. The piston has its longest cross-wise dimension shorter than the internal diameter of the tube body whereby the plunger can freely reciprocate in the tube and air can bypass around the edges of the piston as the plunger is withdrawn from the body.

A circular seal is engaged in a restrained floating relation to the piston on the air chamber side thereof and has a first side comprised of closed cell polyethylene plastic foam. The first side is larger in diameter than the internal diameter of the tube body. The foam side of the seal is disposed in facing relation to the piston on the air chamber side thereof and is frictionally engaged in sealing relation with the internal wall of the tube body. The circular seal has a second plastic stiffener side smaller in diameter than the internal diameter of the body and forms a backing to the foam side of the seal on the air chamber side thereof. The stiffener side of the seal is comprised of the same material as the closed cell foam and is integral thereto. The circular seal has air passages formed there through which are closed when the seal is pressed against the piston, A circular seal cage is secured to the piston on the air chamber side thereof. The cage has at least one central pedestal forming at least three radially outward projecting cantilevered bridge ring seal retainers disposed at equally spaced positions from each other. The retainers are each also equally spaced from the piston a distance greater than the thickness of the circular seal to permit movement of the seal away from the piston a predetermined distance parallel to the cylindrical axis of the tube. The circular seal is captured between the outward projecting cantilevered cantilevered bridges on the air chamber side of the piston and encircle the outer periphery of the central pedestal.

A check valve is disposed proximate to the second end of the tube and has an air flow block side and an air flow discharge side. The air block side is disposed to communicate with the air chamber of the body. A flexible air delivery tube connected to the air flow discharge side of the check valve.

The more important features of the invention have been broadly outlined above in order that the detailed description thereof which follows may be better understood and in order that the present contribution to an improvement in the art may be better appreciated. There are additional specific features of the invention that will be described hereinafter and which will form the subject matter of the claims appended hereto.

With respect to the claims hereof, and before describing at least one preferred embodiment of the invention in detail, it is to be understood that the invention is not to be limited in its application to the details of construction and to the arrangements of the components which are set forth in the following description or illustrated in the drawings. The invention is capable of being created in other embodiments and of being practiced and carried out in various ways. Also, it is to be understood that the phraseology and terminology employed here are for the purpose of description and should not be regarded as limiting.

As such, those skilled in the art will appreciate that the conception upon which this disclosure is based may readily be utilized as a basis for the designing of other forms, structures, methods, and systems for carrying out the several purposes of the present invention. It is important, therefore, that the claims be regarded as including such equivalent constructions in so far as they do not depart from the spirit and scope of the present invention.

Further, the purpose of the appended abstract is to enable the United States Patent and Trademark Office, and the public generally, and especially scientists, engineers, and practitioners of the art who are not familiar with the patent and legal terms or phraseology, to determine quickly from cursory inspection the nature and essence of the technical disclosure of the application. The abstract is neither intended to define the invention of the specification, which is measured by the claims, nor is it intended to be limiting as to the scope of the invention in any way.

OBJECTS OF THE INVENTION

It is therefore an important object of the present invention to provide a high-volume low pressure hand operated air pump.

It is another object of the present invention to provide a high-volume low pressure hand operated lightweight air pump made from low-cost commonly available materials and utilizing simple construction techniques.

It is a further object of the present invention to provide a high-volume low pressure hand operated air pump which is of simple construction, reliable, durable, and corrosion proof.

It is still another object of the present invention to provide a high-volume low pressure hand operated air pump using a double density polyethylene plastic air valve seal having a closed cell plastic foam sealing surface which seals with the air tube and requires no lubrication.

And it is yet a further object of the present invention to provide a high-volume low pressure air pump which can be assembled almost exclusively by the use of room temperature curing glue.

Other objects and advantages of the present invention will become apparent when the method and apparatus of the present invention are considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
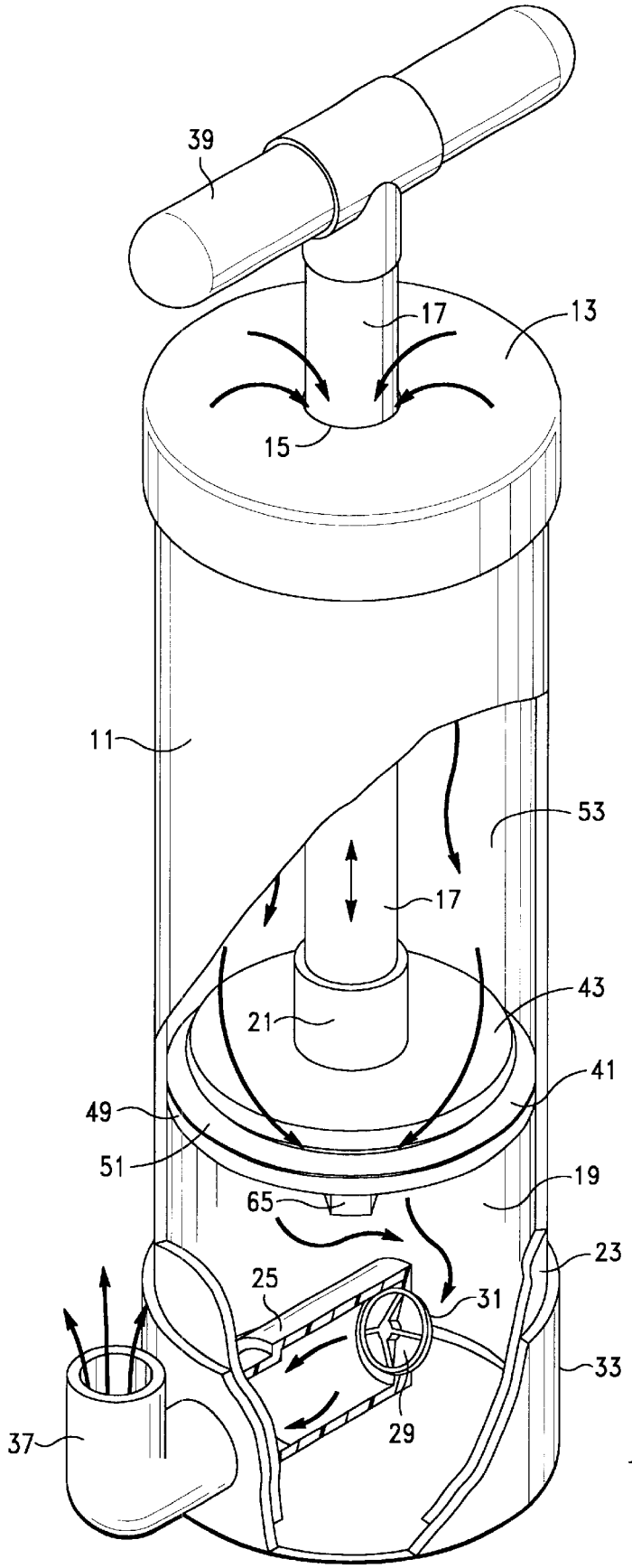
FIG. 1 is a cutaway perspective view of the high-volume low pressure air pump of the present invention.

FIG. 1 shows the internal construction and elements of the high-volume low pressure air pump of the present invention.

The basic integrating element of the present invention is a plastic tube body 11 made essentially of 4- to 6-inch and even larger standard diameter polyvinyl chloride (PVC) plastic pipe cut to the desired length. Obviously the lengths and diameters of the tubes to be utilized are at the manufacturers discretion depending upon the volume of air production desired or limitations imposed by the length of space into which the pump is to be stored. The large size of a typical river raft as used for recreational activities, such as white water river running, requires a large volume air pump for inflation, and hence a larger diameter pipe size is required for the tube body.

The length of the large size rafts permits a relatively long pump to be stored inside the raft under the bottom curve of a cylindrical length of a side portion. However, there is a practical length to the tube body which is essentially limited by operator size. In order to stabilize the pump against the force of the power stroke, when air is forced out of the pump, it is usually positioned with the body of the tube disposed vertically with the bottom end thereof resting on the ground or floor surface. The downward stroke is thereby ballasted by the surface on which the pump is resting. The upward stroke is therefore limited to the height to which a pump operator can reach or effectively operate. As a practical matter, that height is usually not above the operators chest. An operator usually does not move his arms above his head or even his chest when pumping in an effort to pump rapidly. This motion and resulting positioning practically limits the stroke length to a handle which does not extend much above chest high of an operator whereby the body of the pump is approximately half that length.

The tube body 11 has a cap 13 located at the first end 14 thereof with a guide hole 15 disposed on the cylindrical axis of the tube for surrounding the shaft of a plunger 17. In addition to permitting the shaft of the plunger to reciprocate in the tube body, the hole also allows the intake of air into the air chamber 19 of the tube through the guide hole around the shaft. Alternatively, as in addition, air intake holes could be located elsewhere at the first end of the tube. The air chamber of the tube body is formed between the internal end 21 of the plunger shaft and lower or second end 23 of the tube.

Figure 2:
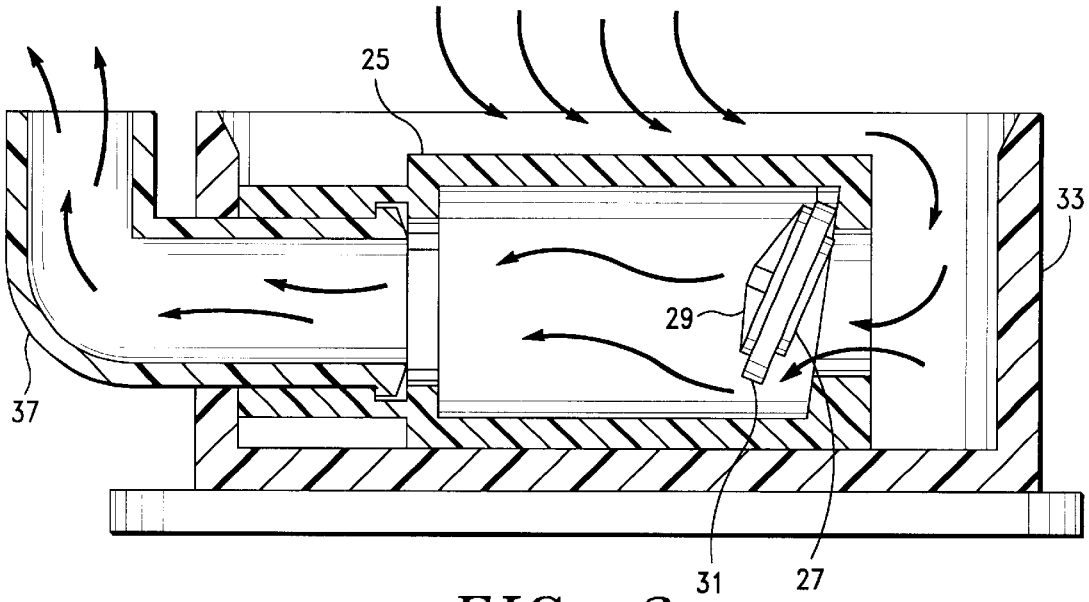
FIG. 2 is a side elevation in section of the lower end cap of the air pump showing the check valve thereof.

A check valve 25, shown in detail in FIG. 2, is disposed internally of the tube body 11 proximate to the second end 23 thereof opposite from the guide hole 15 located at the first end 14 thereof. The check valve has an air flow block side 27 and an air flow discharge side 29. The air flow block side of the check valve closes to block air flow into the air chamber 19 when the plunger shaft 17 is withdrawn therefrom. The air flow discharge side of the valve opens to allow air to be expelled from the air chamber when the plunger shaft of the pump is pushed into the air chamber. The air flow block side of the check valve is disposed to communicate with the air chamber of the tube body.

In the preferred embodiment of the invention, the check valve 25 is disposed internally of the pump tube body 11 secured to the second end 23 thereof although in a more costly embodiment or arrangement, the check valve could be integrated into the wall of the tube body. A rubber flapper 31 irrigation PVC check valve is glued to a second cap 33 which is glued to and seals the second end of the tube body. The air flow block side 27 of the valve is exposed to the air chamber 19 environment, and the air flow discharge side 29 of the valve is connected by a short pipe 37 through the wall of the tube body to communicate with the atmosphere. A flexible air delivery tube is connected to the air flow discharge side of the check valve by being connected to the pipe extending from the check valve through the tube body.

The plunger shaft 17 is disposed partially internally of the tube body 11. It extends through the guide hole 15 at the first end of the body and is formed to reciprocate therein. The shaft includes a handle 39 secured the first end 40 thereof disposed external to the body. In its simplest embodiment, a simple T handle is glued to the first end of the plunger shaft made from a piece of PVC pipe and a PVC T fitting. A more costly molded D handle could just as easily be glued to the external first end of the shaft. The shaft reciprocates in the tube body when the handle of the pump is actuated by a pumper person.

An air intake floating seal 41 is secured to the second or opposite end 21 of the plunger shaft 17 and is disposed internally of the tube body 11. The length of the shaft is longer than the length of the tube body, and the body forms the air chamber 19 between the air intake seal on the shaft and the check valve 25 disposed at the bottom of the second end 23 of the tube body.

Figure 4:
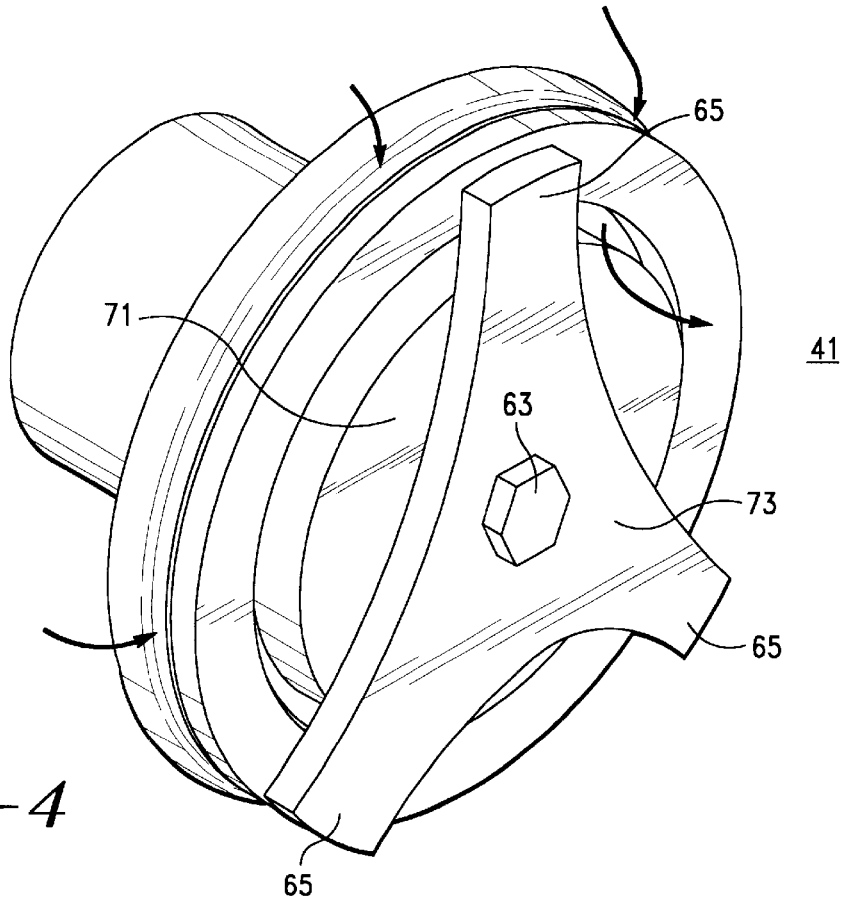
FIG. 4 is a the same view as FIG. 3 showing an alternative seal retainer cage configuration.
Figure 5:
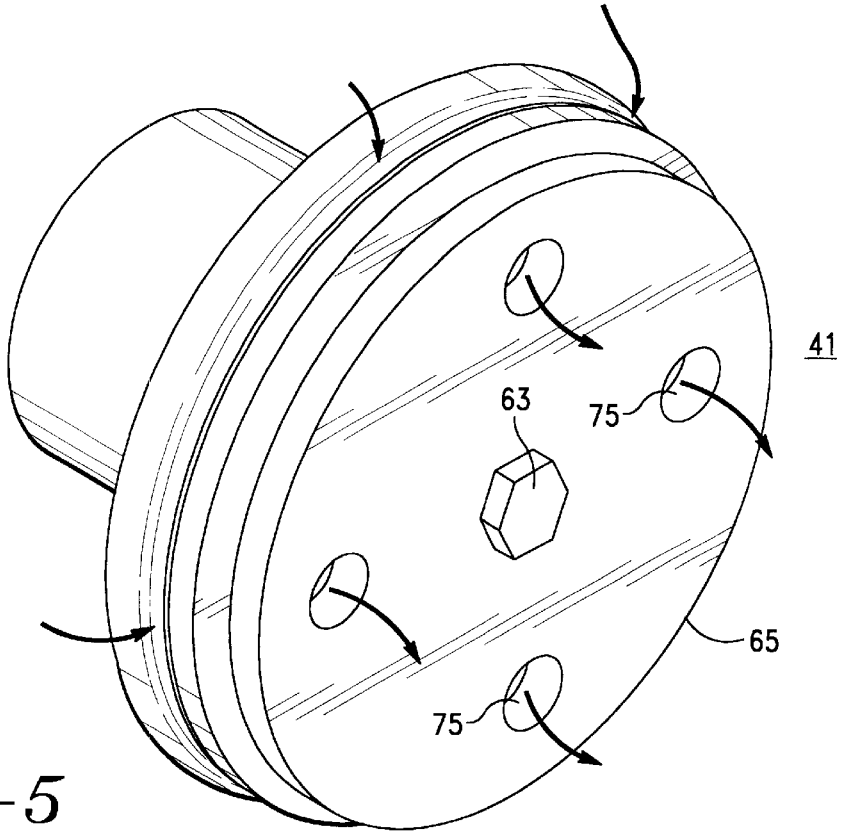
FIG. 5 is a the same view as FIGS. 3 & 4 showing still another alternative seal retainer cage configuration.

The air intake seal 41 includes a piston 43 secured to the second end 21 of the plunger shaft 17. The seal keeps the internal second end of the shaft and the piston centered in the body by their engagement with the floating seal. The piston can be of varied configurations as shown in FIGS. 3–5, but it needs to be of a configuration which seals the air passages in the floating seal when the plunger is pushed into the air chamber 19 to pump air.

Figure 3:
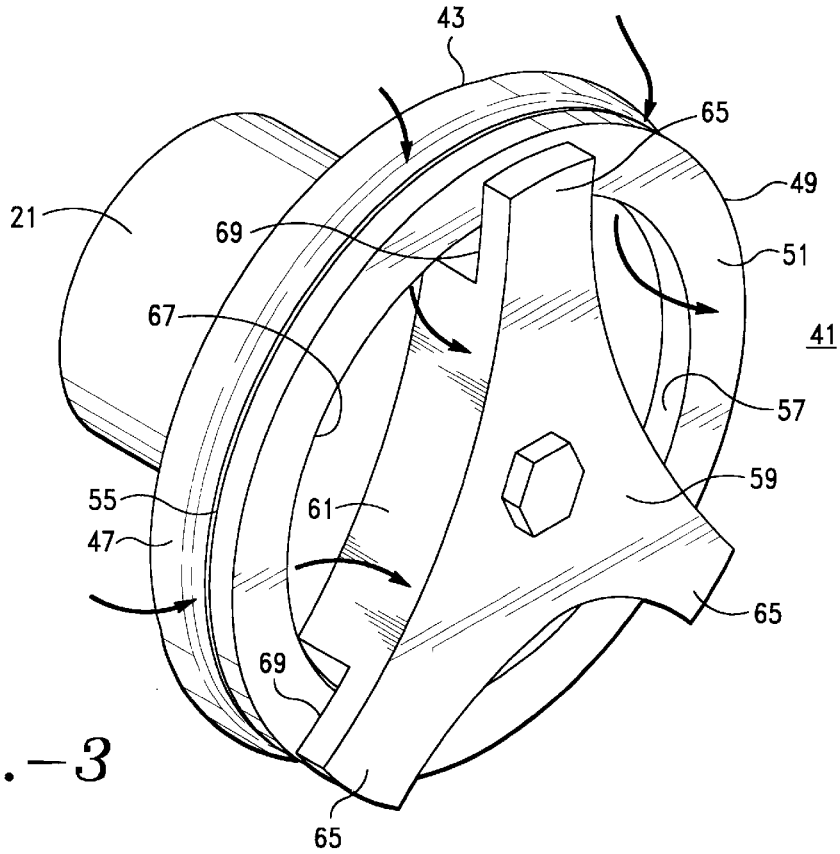
FIG. 3 is a perspective view of the floating air seal which is secured to the lower end of the plunger shaft of the air pump.
Figure 6:
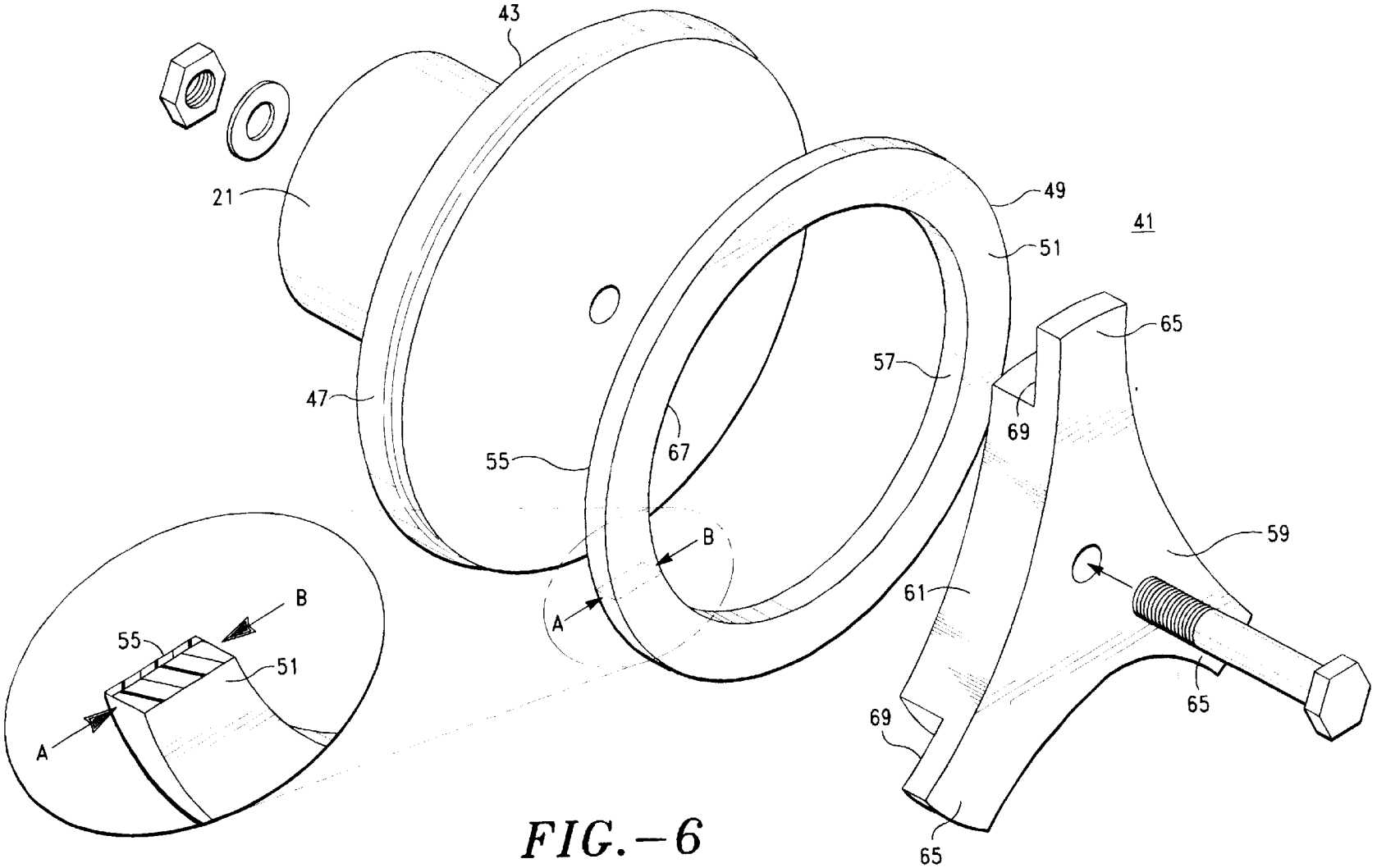
FIG. 6 is an exploded view of FIG. 3.

In the preferred embodiment of the invention shown in FIGS. 3 and 6, the piston 43 is formed of a disk smaller in diameter than the internal diameter of the tube body 11 with a hemispherically rounded peripheral edge 47. The smaller diameter of the disk permits air to bypass and flow around the edges of the piston into the air chamber 19 on the air intake stroke as the plunger 17 is withdrawn from the body and the floating seal 41 unseats from the piston and the check valve 25 is closed.

A circular or ring seal 49 is engaged in a restrained floating relation to the piston 43 on the air chamber 19 side thereof. The seal has a first side 51 which is comprised of a closed cell plastic foam which is larger in diameter than the internal diameter of the tube body 11 by a small amount which causes the seal to be compressively frictionally engaged in sealing relation with the internal wall 53 of the tube body.

The circular or ring seal 49 has a second plastic stiffener side 55 smaller in diameter than the internal diameter of the tube body 11. The stiffener side forms a backing to the foam side 51 of the seal and is disposed in facing relation to the piston on the air chamber 19 side thereof. The stiffener side is comprised of the same material as the closed cell foam on the reverse side thereof and is formed integral thereto. A circular disk configured seal has one or more air passages formed there through which are closed when the seal is pressed against the piston. The central opening 57 of a ring seal forms the air passage in an annular shaped ring seal.

A circular or ring seal cage 59 having at least one central pedestal 61 is removably secured by a bolt 63 to the piston 43 on the air chamber 19 side thereof so that the seal 49 can be inserted under the cage during assembly of the floating valve 41. The seal is centered on the piston by its loose floating contact with the pedestal. The cage forms at least three radially outward projecting cantilevered bridge ring seal retainers 65 for holding the circular or ring seal in captured floating relation with respect to the face 67 of the piston. The seal seats against the sealing face of the piston to close the air intake end of the air chamber during the air discharge stroke of the pump.

The retainers 65 are disposed at equally spaced positions around the face 67 of the piston 43 from each other, and the seal contacting surfaces 69 of the retainers are also equally spaced from the piston a distance greater than the thickness of the circular or ring seal 49 to permit movement of the seal away from the piston a parallel distance perpendicular to the cylindrical axis of the tube body 11 to let air flow around the seal when it is unseated from the piston.

The seal cage 59 can be manufactured from disks or cast or machined from a solid piece of plastic as shown in FIG. 3. A simple construction shown in FIG. 4 is comprised of a central disk 71 and a top plate 73. Both forms of seal cage are removably secured by a bolt 68 to the piston 43. The central disk is constructed of a diameter sufficiently smaller than the internal diameter of the opening 57 in the annular disk 49 of the floating seal 41 and of a sufficient thickness to permit adequate air flow around the seal and between the disk and top plate when the floating seal is unseated. flow around the seal and between the disk and top plate when the floating seal is unseated.

The top plate 73 of the simple construction is in the form of a star washer with each star point comprising a cantilevered projecting bridge 65 for capturing the seal 49 between the star point and the sealing face 67 of the piston 43. The materials for the pedestal disk and the star washer for such a construction can be cut from flat sheets of plastic such as high-density polyethylene (HDPE).

In the preferred embodiment of the invention, only three cantilevered retainers 65 are necessary to perform the function although the number could be increased from more than three to an infinite number at which point the top plate 73 becomes a solid cantilevered circular flange as shown in FIG. 5. However, such a design would require air holes 75. Air flow in the floating seal is shown in the FIGS. by the black arrows.

The central pedestal 61 ties the bridges 65 together and secures them to the piston 43. The circular or ring seal 49 surrounds the pedestal or, if a multiple of pedestals are employed, the pedestals project through the seal. The pedestals must be formed to provide for the passage of air around the peripheral edges of the piston into the air chamber during the air intake pump stroke and to permit the sealing of the air passages in the seal against the piston during the power or air discharge pump stroke. If a central singular pedestal is utilized, the seal may be an annular disk or a flat ring as shown in FIGS. 3–5. If a different configuration pedestal is utilized, the seal will be circular with holes to fit around the particular pedestal configuration and air passages formed therein to function as described during the air intake stroke.

In the preferred embodiment of the invention, the seals 49 are generally flat annular disks having a consistent thickness around the circumference and width of the disk. Both sides are flat so that the seals can be cut from flat sheets of material. However, either side of the disk could be of any curvature so long as the stiffener side 55 thereof performs the required sealing function with the piston and adequately supports the foam side 51 to prevent deformation which would destroy the sealing relation of the ring seal with the internal wall 53 of the tube body 11.

In a preferred embodiment of the invention, the seals 49 are made of polyethylene plastic with the first or foam side 51 being a seven-pound low density polyethylene (LDPE) which weighs seven pounds per cubic foot. The second or stiffener side 55 is a solid polyethylene, also called an LDPE, with a density of approximately 0.9997 times the weight of water and approximately 30 mils thick for a six-inch diameter pump utilizing a three-point star ring cage 59. The two forms of LDPE material are chemically identical and are intimately bonded during manufacture by a calendaring process into a single integrated sheet of material. As a result, they are factory welded into a single piece of material which prevents delamination. No lubrication of the seal is required to effect a very high-performance seal with the internal wall of the tube body.

The circular or ring seal 49 is captured between the outward projecting cantilevered bridges 65 on the air chamber side 19 of the piston 43 and encircles the outer periphery of the pedestal(s) 61. The seal is disposed and maintained in perpendicular relationship with respect to the cylindrical axis of the tube body 11 and the interior wall thereof 53 as a result of its sealing relation with the piston. As the plunger shaft 17 is withdrawn from the tube body, the check valve 25 closes and the ring seal unseats from the piston but remains in its perpendicular relationship with respect to the tube body during the transition from sealing to unsealed due to its frictional contact with the tube body internal wall. The ring seal cage engages in a three or multiple point restraining contact with the stiffener side of the ring seal, depending upon the number of bridges employed, for stabilization of the ring seal in the perpendicular relationship with respect to the tube body at the pre-determined distance from the piston effected by the restraining contact of the retainers. This spacing allows air to pass around the peripheral edges of the piston and flow into and through the center 57 of the ring seal and into the air chamber 19.

When the cycle is reversed and the plunger 17 is pushed into the tube body 11, the check valve 25 opens and the stiffener side 55 of the ring seal 49 seats against the piston 43 and air is forced out of the air chamber 19 through the check valve 25 into the delivery tube 37.

Thus, it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

I claim:

1. A high volume low pressure air pump comprising an elongated tube body having a guide hole located proximate to a first end thereof and disposed on the cylindrical axis of said tube for surrounding the shaft of a plunger, said body forming an air chamber between the internal end of said plunger shaft and a second end of said tube, an air intake passage disposed proximate said first end of said tube for allowing the intake of air into said tube through said passage, a plunger shaft disposed partially internally of said tube body and extending through said guide hole of said body and formed to reciprocate therein, said shaft including a handle secured at a first externally exposed end thereof, the length of said shaft being longer than the length of said body, an air intake floating seal secured to the internally disposed second opposite end of said shaft, said air intake seal including a piston secured to said second end of said plunger, said piston having its longest cross-wise dimension shorter than the internal diameter of said tube body whereby said the plunger can freely reciprocate in said tube and air can bypass around the edges of said piston as said plunger is withdrawn from said body, a circular seal engaged in a restrained floating relation to said piston on said air chamber side thereof and having a first side comprised of closed cell plastic foam, said first side being larger in diameter than the internal diameter of said tube body, and being frictionally engaged in sealing relation with the internal wall of said tube body, said circular seal having a second plastic stiffener side smaller in diameter than said internal diameter of said body and forming a backing to said foam side of said seal on said air chamber side of said seal and being disposed in facing relation to said piston on said air chamber side thereof, said stiffener side of said seal being comprised of the same material as said closed cell foam and integral thereto, said circular seal having at least one air passage formed there through which is closed when said seal is pressed against said piston, a circular seal cage having at least one central pedestal removably in secured to said piston on the air chamber side thereof and forming at least three radially outward projecting cantilevered bridge ring seal retainers disposed at equally spaced positions from each other, said retainers each being equally spaced from said piston a distance greater than the thickness of said circular seal to permit movement of said seal away from said piston a predetermined distance parallel to the cylindrical axis of said tube, said circular seal being captured between said outward projecting cantilevered bridges on the air chamber side of said piston and encircling the outer periphery of said central pedestal, a check valve disposed proximate to said second end of said tube and having an air flow block side and an air flow discharge side, said air block side being disposed to communicate with said air chamber of said body, an air delivery tube connected to said air flow discharge side of said check valve, whereby as said plunger is withdrawn from said tube body said check valve closes and said circular seal unseats from said piston and said circular seal cage captures said floating circular seal in restraining contact for stabilization thereof in perpendicular relationship with respect to the cylindrical axis of said tube body and said interior wall of said body at said pre-determined distance from said piston thereby allowing air to pass around the peripheral edges of said piston and to flow into and through said the air passages of said circular seal and into said air chamber, and whereby as said plunger is pushed into said tube body said the check valve opens and said circular seal seats against said piston closing said air passages in said circular seal and air is forced out from said air chamber through said check valve into said delivery tube.

2. The high-volume low pressure pump of claim 1 wherein said circular seal cage forms a cantilevered circular flange extending from said pedestal which captures said circular seal during withdrawal of said plunger from said tube body, said flange having pair passages formed therethrough disposed radially inward of the internal circumference of said seal.

3. A high volume low pressure air pump comprising an elongated plastic cylindrical tube body having a guide hole disposed on the cylindrical axis of said tube at a first end thereof for surrounding the shaft of a plunger and allowing the intake of air into said tube through said guide hole around said shaft, a rubber flapper check valve disposed internally of said body at the opposite second end thereof from said guide hole and having an air flow block side and an air flow discharge side, an air delivery tube connected to said discharge side of said check valve, a plunger shaft disposed partially internally of said tube body and extending through said guide hole of said body and formed to reciprocate therein, said shaft including a cross handle secured at a first externally exposed end thereof and an air intake floating seal secured to the opposite second end of said shaft disposed internally of said body, the length of said shaft being longer than the length of said body and said body forming an air chamber between said air intake seal and said check valve, said air intake seal including a piston secured to said second end of said plunger, said piston being formed of a disk smaller in diameter than the internal diameter of said tube body whereby air can bypass around the edges of said piston as said plunger is withdrawn from said body, a ring seal engaged in a restrained floating relation to said piston on said air chamber side thereof and having a first side thereof being larger in diameter than the internal diameter of said tube body, said first side being comprised of closed cell polyethylene plastic foam and being frictionally engaged in sealing relation with the internal wall of said tube body, said ring seal having a second plastic stiffener side smaller in diameter than said internal diameter of said body and forming a backing to said foam side of said seal and being disposed in facing relation to said piston on said air chamber side thereof, said stiffener side of said seal being comprised of the same plastic material as said closed cell foam and integral thereto, a ring seal cage having a central pedestal removably secured to said piston on the air chamber side thereof and forming three radially outward projecting cantilevered bridge ring seal retainers disposed at 120 degree positions from each other, said retainers being spaced from said piston a distance greater than the thickness of said ring seal to permit movement of said ring seal away from said piston a predetermined distance, said ring seal being captured between said outward projecting cantilevered bridges on the air chamber side of said piston and encircling the outer periphery of said central pedestal, whereby as said plunger is withdrawn from said tube body said check valve closes and said ring seal unseats from said piston and said ring seal cage forms three-point restraining contact with said stiffener side of said ring seal for stabilization of said ring seal in perpendicular relationship with respect to the cylindrical axis of said tube body and said interior wall of said body at said predetermined distance from said piston thereby allowing air to pass around the peripheral edges of said piston and to flow into and through the center of said ring seal and into said air chamber, and whereby as said plunger is pushed into said tube body said the check valve opens and said foam side of said ring seal seats against said piston and air is forced out from said air chamber through said check valve into said delivery tube.

* * * * *